US005720892A

United States Patent [19]

DeAngelis et al.

[11] Patent Number: 5,720,892

[45] Date of Patent: Feb. 24, 1998

[54] METHOD OF MAKING PATTEREND CONDUCTIVE TEXTILES

[75] Inventors: Alfred R. DeAngelis; Andrew D. Child, both of Spartanburg, S.C.; Dennis E. Green, Elkhart, Ind.

[73] Assignee: Milliken Research Corporation, Spartanburg, S.C.

[21] Appl. No.: 729,867

[22] Filed: Oct. 15, 1996

Related U.S. Application Data

[63] Continuation of Ser. No. 440,273, May 12, 1995, Pat. No. 5,624,736.

[51] Int. Cl.[6] ..... B44C 1/22; B32B 3/00

[52] U.S. Cl. ..... 216/7; 216/83; 427/121; 428/196

[58] Field of Search ..... 216/7, 83; 427/121; 428/197

[56] References Cited

U.S. PATENT DOCUMENTS

| | | | |
|---|---|---|---|
| 4,803,096 | 2/1989 | Kuhn et al. | 427/121 |
| 4,981,718 | 1/1991 | Kuhn et al. | 427/121 |
| 5,102,727 | 4/1992 | Pittman et al. | 428/259 |
| 5,162,135 | 11/1992 | Gregory et al. | 427/121 |
| 5,292,573 | 3/1994 | Adams, Jr. et al. | 428/196 |
| 5,316,830 | 5/1994 | Adams, Jr. et al. | 426/195 |

*Primary Examiner*—R. Bruce Breneman
*Assistant Examiner*—Michael E. Adjodha
*Attorney, Agent, or Firm*—Terry T. Moyer; Timothy J. Monahan

[57] ABSTRACT

A method of making a patterned conductive textile is provided by depositing a conductive polymer film on the fabric to provide a resistivity of 1000 ohms per square or less, coating selected areas of the fabric with a protective film, to protect the conductive polymer from a chemical etching agent, to provide an oxygen barrier and to retain areas of high conductivity, applying a chemical etching agent to the fabric thereby degrading the conductive polymer film on areas of the fabric which have not been coated with the protective film and create areas of low conductivity and rinsing the fabric to remove any residual etching agent.

10 Claims, 2 Drawing Sheets

METHOD OF MAKING PATTEREND CONDUCTIVE TEXTILES

This is a continuation application of patent application Ser. No. 08/440,273, filed May 12, 1995 for METHOD OF MAKING PATTERNED CONDUCTIVE TEXTILES, now U.S. Pat. No. 5,642,736.

BACKGROUND OF THE INVENTION

This invention relates generally to textile fabrics having conductive polymer films thereon, and in particular to fabrics having a pattern formed by conductive and nonconductive areas.

Textiles, such as fibers, yarns and fabric, having a conductive polymer coating, are disclosed by Kuhn et al. in U.S. Pat. No. 4,803,096. These electrically conductive textiles have been suggested for use in the control of static electricity, attenuation of electromagnetic energy and resistance heating. For some applications, it has been found to be desirable to provide a textile fabric having anisotropic electrical conductivity. In Pittman et al, U.S. Pat. No. 5,102,727 and Gregory et al, U.S. Pat. No. 5,162,135, textiles having a conductivity gradient were prepared by blending conductive and non-conductive yarns, or by contacting the conductive textile with a chemical reducing agent, respectively. While satisfactory for some applications, the methods used to product conductivity gradients do not readily lend themselves to the manufacture of more complex patterns.

Alternatively, patterned electrically conductive textiles, that is fabrics having a pattern of conductive and non-conductive areas, may be provided by selectively removing portions of the conductive polymer film with, for example, high velocity water jets, as in Adams, Jr. et al, U.S. Pat. No. 5,292,573 and U.S. Pat. No. 5,316,830. A characteristic of the water jet process is that some, but not all of the conductive polymer film is removed from the textile fiber. Accordingly, the difference in conductivity between treated and untreated areas of the fabric may not be as distinct as desired. Further, the process requires the use of relatively sophisticated equipment, which is not readily available.

A limitation on the application of conductive polymers in general has been their lack of stability to environmental conditions resulting in a decline in conductivity with age. The influence of temperature, humidity and oxidation level on the stability of conductive polymers was discussed in Munstedt, H., "Aging of Electrically Conducting Organic Materials", Polymer, Vol. 29, page 296–302 (February 1988). It has been proposed to apply a protective film or laminate to the conductive polymer to exclude oxygen and otherwise limit environmental exposure. However, one of the advantages of conductive textile fabric is its flexibility, which may be diminished by the application of protective coatings to the fabric.

SUMMARY OF THE INVENTION

Therefore, an object of the invention is to provide a conductive textile fabric having conductive and non-conductive areas which form a pattern. Another object of the invention is to provide a method of manufacturing conductive textile fabric, which may be adapted to the formation of complex patterns of conductive and non-conductive areas. Another object of the invention is to provide a patterned conductive textile with high resolution between conductive and non-conductive areas. Yet, another object of the invention is to provide a conductive textile with a protective coating over the polymer film. Another object of the invention is to protect a conductive polymer film on a textile substrate, with a minimum impact on the flexibility of the substrate.

Accordingly, a fabric having patterned conductivity is provided by depositing a conductive polymer film on the fabric; coating selected areas of the fabric with a second polymer film which is resistant to a chemical etching agent used to degrade the conductive polymer; and applying a chemical etching agent to the fabric to degrade the conductive polymer on areas of the fabric which have not been coated with the second polymer film, thereby creating areas of low conductivity adjacent the areas of high conductivity.

In addition to meeting the aforementioned objectives, the composition and method of the present invention has the advantage that only those areas of the fabric which retain the conductive polymer film are coated with the protective polymer film (second polymer), thereby maximizing the flexibility of the fabric and conserving use of the protective polymer coating. Further, the invention preferably comprises one or more of the following feature:

- the tolerance for placement of areas of high conductivity and the areas of low conductivity is ±2 mm or less, preferably ±0.5 mm or less;
- the areas of low conductivity are devoid of the conductive polymer film;
- the areas of low conductivity are devoid of the protective polymer film coating;
- the areas of high conductivity have a resistivity of 1000 Ωper square or less;
- the protective polymer film is an oxygen barrier; and
- the ratio of conductivity between the areas of high conductivity and the areas of low conductivity is 100 or greater.

DETAILED DESCRIPTION OF THE INVENTION

Figure 1:
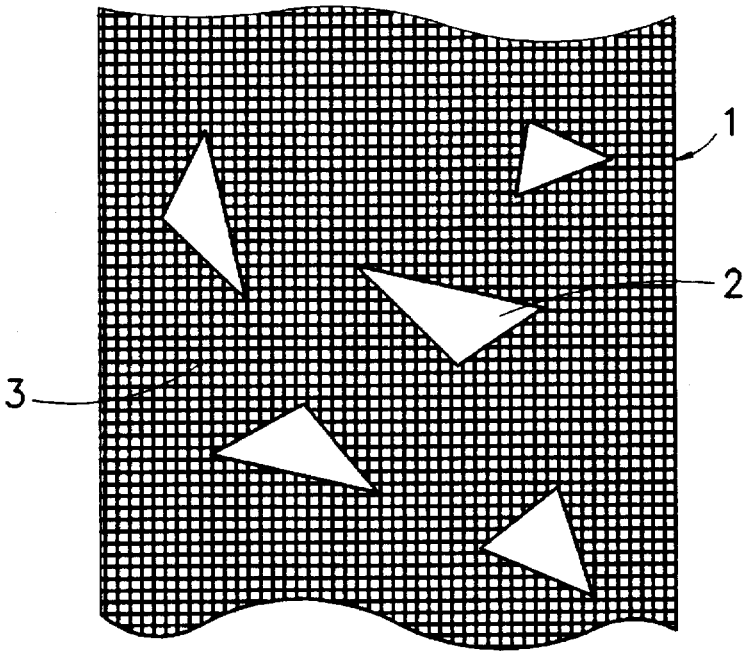
FIG. 1 is a woven fabric having a conductive polymer film which is selectively coated with a protective film.

Without limiting the scope of the invention, the preferred embodiments and features are hereinafter set forth. Unless otherwise indicated, all parts and percentages are by weight and conditions are ambient i.e. one atmosphere of pressure and 25° C. The terms aryl and arylene are intended to be limited to single and fused double ring aromatic hydrocarbons. Unless otherwise specified, aliphatic hydrocarbons are from 1 to 12 carbon atoms in length, and cycloaliphatic hydrocarbons comprise from 3 to 8 carbon atoms.

The fabric of the present invention may have a woven, knit or non-woven construction. The fibers comprising the fabric have a conductive polymer film deposited thereon. By way of example, the conductive polymer may be selected from polypyrrole, polyaniline, polyacetylene, polythiophthene, poly-p-phenylene, poly(phenylene sulfide), poly(1,6-heptadiyne), polyazulene, poly(phenylene vinylene), and polyphthalocyanines. Preferably, the conductive polymer is selected from polypyrrole, polyaniline and polythiophthene.

As used herein, the terms polypyrrole, polyaniline, polythiophthene, etc. are intended to include polymers made not only from the polymerization of pyrrole, aniline, and thiophthene respectively, but also polymers made from substituted pyrrole, aniline, and thiophthene monomers, as is known to those skilled in the art. By way of example and limitation, polypyrrole may be synthesized from the following monomers or combinations thereof; pyrrole, 3- and 3,4-alkyl or aryl-substituted pyrrole, N-alkylpyrrole, and N-arylpyrrole. Similarly, by way of example, the following monomers or combinations thereof are suitable for polyaniline synthesis: aniline, 3, and 3,4-chloro, bromo, alkyl or aryl-substituted aniline.

Fabrics having an electrically conductive polymer film deposited thereon are referred to generally herein as conductive fabrics. Methods of depositing a conductive polymer film on a textile fiber are disclosed in the following patents: Kuhn et al, U.S. Pat. No. 4,803,096; Kuhn, U.S. Pat. No. 4,877,646; and U.S. Pat No. 4,981,718, all of which are incorporated by reference. The fibers may be treated according to the aforementioned methods in the form of staple, continuous monofilament, spun yarn, continuous multifilament yarn or in the form of a fabric. Preferably, the textile is in the form of a woven or knit fabric constructed from continuous, multifilament yarn, when the fabric is treated to provide a conductive polymer film on the fibers.

The conductive polymer is formed on the textile material in amounts corresponding to about 0.5% to about 4%, preferably 1.0% to about 3% and most preferred about 1.5% to about 2.5%, by weight based on the weight of the textile. Thus, for example, for a fabric weighing 100 grams, a polymer film of about 2 grams may be formed on the fabric.

A wide variety of natural and synthetic fibers may be used as the textile substrate. By way of example, the following substrates may be employed: polyamide fibers, including nylon, such as nylon 6 and nylon 6,6, and aramid fibers; polyester fibers, such as polyester terephthalate (PET), polyolefin fibers, such as polypropylene and polyethylene, acrylic fibers, polyurethane fibers, cellulosic fibers, such as cotton, rayon and acetate; silk and wool fibers, and high modulus inorganic fibers, such as glass, quartz and ceramic fibers.

Electrically conductive textiles having a resistivity of 1000 Ω per square or less, preferably 500 Ω per square or less find utility in the present invention. Standard test methods are available in the textile industry and, in particular, AATCC test method 76-1982 is available and has been used for the purpose of measuring the resistivity of textile fabrics. According to this method, two parallel electrodes 2 inches long are contacted with the fabric and placed 1 inch apart. Resistivity may then be measured with a standard ohm meter capable of measuring values between 1 and 20 million ohms. Measurements must then be multiplied by 2 in order to obtain resistivity in ohms on a per square basis. While conditioning of the samples may ordinarily be required to specific relative humidity levels, it has been found that conditioning of the samples made according to the present invention is not necessary since conductivity measurements do not vary significantly at different humidity levels. The measurements reported are, however, conducted in a room which is set to a temperature of 70° F. and 50% relative humidity. Resistivity measurements are reported herein and in the examples in ohms per square (Ω/sq) and under these conditions the corresponding conductivity is one divided by resistivity.

The next step of the process is to cost selected areas of the conductive fabric with a protective film, where it is desired to maintain electrical conductivity (areas of high conductivity). The protective film is resistant to a chemical etching agent which is subsequently applied to degrade the conductive polymer film on those areas of the fabric which have not been protected (areas of low conductivity). The protective film has a second function as well, that is to serve as an oxygen and moisture barrier, thereby increasing the stability of the conductive polymer film underneath. The protective film is preferably non-conductive.

Any of a large number of compositions may be useful in coating selected areas of the conductive fabric with a protective film. By way of example, the composition may comprise compounds selected from poly(vinyl chloride), parrafin, poly(vinylidene chloride)-poly(acrylic acid) copolymer (PVdC-PAA), poly(vinylidene chloride) (PVdC), polyester and polyolefin. Preferably, the composition is a polymer.

Conventional coating techniques may be employed for providing a conductive film on the conductive fabric in a desired pattern. Examples include screen printing, transfer printing, lamination and masking. Preferably, both sides of the conductive fabric are treated as mirror images, so that areas of high conductivity are protected on both the face and back of the fabric.

The protective composition may be applied to the fabric in the form of a dispersion, emulsion, plastisol, solution, molten, fine particulate or film. The protective compositions may be cured to form a continuous film by techniques known to those in the coating, printing or lamination arts and depending on the form of the composition applied, may include one or more of the following processes: heated to remove volatile components; melted; cooled to solidify; polymerized or cross linked in situ by heating, catalyzation and/or free radical initiation. For example, emulsions of PVdC-PAA copolymer are heat-set at temperatures of between 300° and 400° F. for approximately 1 to 3 minutes to cure the resin.

Generally, the protective film add on, when cured, to those areas of high conductivity intended to be protected is from 10 to 200 wt. %, preferably 20 to 150 wt. % per side of fabric, based on the weight of the fabric, and may range from 0.01 to 0.2 mm in thickness, preferably 0.02 to 0.1 ram, per side of fabric.

Referring to FIG. 1, conductive fabric 1 having a conductive polymer film thereon is coated in selected areas 2 with a protective film. Other areas of fabric 1, designated as uncoated area 3, remain unprotected.

Next, the conductive fabric having selected areas coated with a protective film, is subjected to a chemical etching agent which degrades the conductive polymer film in the unprotected areas. The use of reducing agents to degrade a conductive polymer film is disclosed in Gregory et al, U.S. Pat. No. 5,162,135, incorporated by reference. Examples of suitable reducing agents are zinc formaldehyde sulfoxylate, sodium formaldehyde sulfoxylate, thiourea dioxide, sodium hydrosulfite, sodium borohydride, zinc, hydrazine, stannous chloride, and ammonium hydroxide. Preferably, the reducing agent contains a zinc ion. More preferably, the reducing agent is zinc formaldehyde sulfoxylate. Aqueous solutions of the reducing agent are also preferred.

Alternatively, oxidizing agents may be used as the chemical etching agent to remove the conductive polymer film from unprotected areas. By way of example, suitable oxidizing agents include sodium hypochlorite and hydrogen peroxide. Aqueous solutions of the oxidizing agent are preferred.

The fabric may be contacted with the chemical etching agent by any of a number of methods, including emersion, padding, spraying or by transfer roller. The contact time required to degrade the conductive polymer film the desired degree, depends on the reactivity, concentration, and temperatures, among other factors. For example, a 1½% aqueous solution of sodium hypochlorite will remove a polypyrrole film in 2 minutes at 25° C.

Following treatment with the chemical etching agent, the fabric may be treated with a neutralizing or deactivating solution or simply rinsed.

Figure 2:
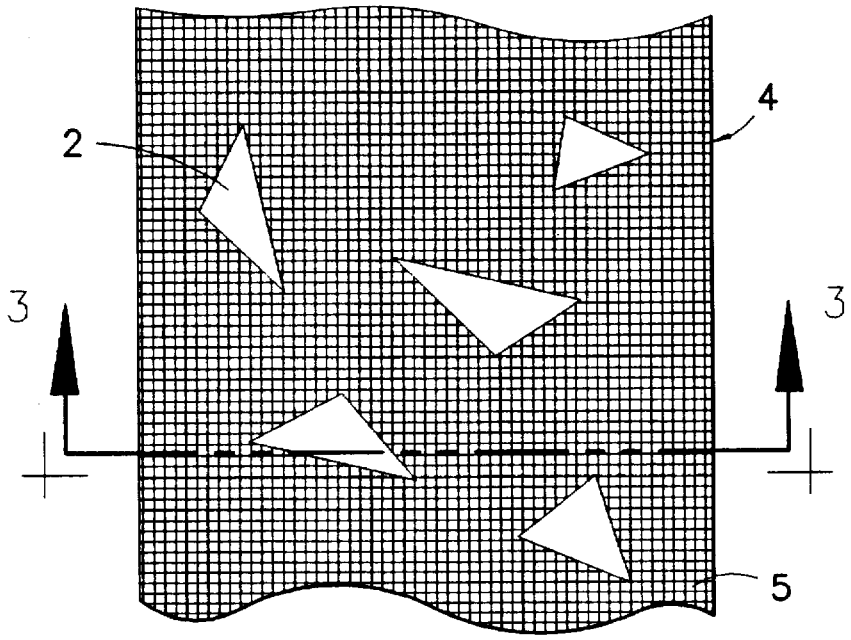
FIG. 2 is a woven fabric which has been treated with a chemical etching agent to remove the conductive polymer from unprotected areas.

Referring to FIG. 2, patterned conductive fabric 4 results from application of a chemical etching agent to the conductive fabric 1 of FIG. 1. The unprotected area 5 of patterned conductive fabric for is devoid of the conductive polymer film and now represents an area of low conductivity, and is essentially non-conductive, that is the conductivity is not substantially different from the fabric substrate. Area 2, which is coated with the protective film, represents an area of high conductivity, which is substantially equivalent to the conductivity of the conductive fabric prior to a application of the chemical etching agent.

Figure 3:
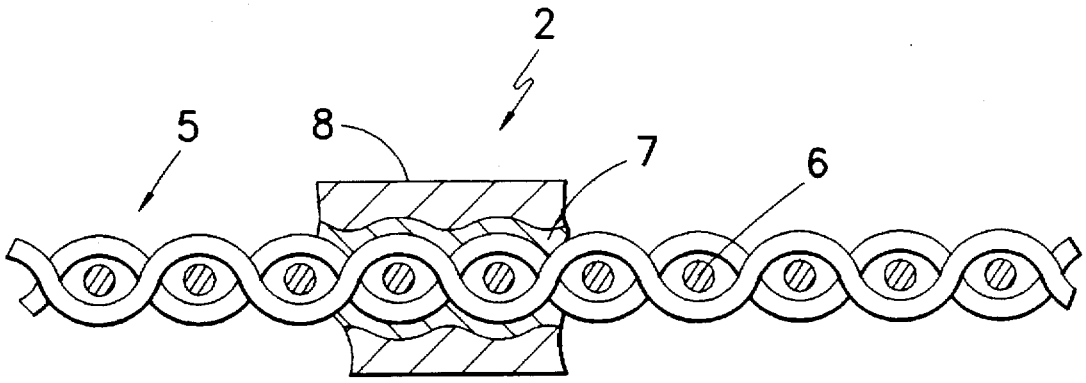
FIG. 3 is a cross section of a woven fabric showing areas of high conductivity which have a protective film thereon, and areas of low conductivity.

FIG. 3, is a cross section along plane A—A of FIG. 2. Yarns 6 are devoid of any coating in the area 5 of low conductivity and have conductive polymer 7 and protective film 8 in the area 2 of high conductivity.

The "tolerance" is used herein to describe the variance between the desired position of a particular area of high conductivity or low conductivity, and the position which is actually achieved by the process. For example, if the specification called for a 2 cm×2 cm square area of high conductivity, with a resolution of ±2 mm, a 1.8 cm×1.8 cm square up to a 2.2 cm×2.2 cm square would be acceptable. By employing the present invention, it is possible to achieve tolerances of ±1 mm or less, and in particular tolerances of ±0.5 mm or less.

Higher resolutions may best be achieved by employing fabrics which weigh less than 4 ounces per square yard, preferably less than 3 ounces per square yard. Additionally, fabrics made with yams having a denier of 70 to 420 are preferred for achieving the best resolutions.

An infinite number of patterns of conductive and non-conductive areas may be created by using the present invention. The ratio of conductive to non-conductive areas may range any where from 1:99 to 99:1, and is preferably between 30:70 and 70:30, respectively.

The invention may be further understood by reference to the following examples but is not intended to be unduly limited thereby.

EXAMPLE 1

A woven fabric consisting of 70 denier textured polyester yarns, weighing 2 ounces per square yard was made conductive by coating the fabric with polypyrrole according to Kuhn et al, U.S. Pat. No. 4,803,096. A mixture consisting of 88 parts PVdC-PAA copolymer emulsion (40 wt. % solids), 2 parts guar gum thickener and 10 parts water, was applied by flat screen printing in a predetermined pattern to the fabric. A mirror image screen was affixed to the back of the fabric and the mixture was next screen printed onto the back side of the fabric also. The fabric was removed and allowed to air dry, until the PVdC-PAA polymer composition was dry to the touch (approximately 30 minutes), and then the fabric was cured at 300° F. for 10 minutes.

The fabric was them immersed in a 1% sodium hypochlorite solution for 2 minutes and removed. The fabric was allowed to drip dry for approximately 2 minutes rinsed with copious amounts of water, and allowed to air dry.

EXAMPLE 2

The following example demonstrates the improved stability of the conductive polymer film on fabric, when the film has been coated with a protective polymer.

A knitted mesh fabric consisting of 150 denier, textured polyester yarn and weighing approximately 2 ounces per square yard was made conductive by coating the fabric with polypyrrole according to Kuhn et al, U.S. Pat. No. 4,803,096. The fabric had a microwave attenuation was measured at 8–10 GHz and recorded.

The conductive fabric was cut in half and one of the halves was immersed in an aqueous dispersion of PVdC, removed and cured to provide a uniform coating, with approximately 40 wt. % solids pickup, based on the weight of the conductive fabric.

Next, both the coated and uncoated halves of the conductive fabric were placed in an accelerated aging chamber. After 200 kJ of exposure, the samples were removed and the microwave attenuation was measured. The coated fabric sample retained 72% of its initial attenuation, whereas the uncoated fabric retained less than 5% of its initial attenuation properties.

There are, of course, many alternate embodiments and modifications of the invention, which are intended to be included in the scope of the following claims.

What we claim is:

1. A method of making a fabric having patterned conductivity, comprising the steps of:

depositing a conductive polymer film on the fabric;

coating selected areas of the fabric with a second film, whereby the second film is resistant to a chemical etching agent for the conductive polymer, to retain areas of high conductivity; and applying the chemical etching agent to the fabric and degrading the conductive polymer on areas of the fabric which have not been coated with the second film to create areas of low conductivity.

2. The method of claim 1, wherein the tolerance for the position of the areas of high and low conductivity is ±1 mm or less.

3. The method of claim 2, wherein the etching agent is selected from the group consisting of sodium hypochlorite, hydrogen peroxide, sodium borohydride and ammonium hydroxide.

4. The method of claim 3, wherein the second film is an oxygen barrier.

5. The method of claim 1 wherein the conductive polymer film is selected from the group consisting of polyaniline and polypyrrole and the areas of high conductivity have resistivity of 1000 Ω/square or less.

6. The method of claim 5, wherein the fabric is woven and is constructed of continuous filament yarn selected from the group consisting of polyester, polyamide, polyolefin and glass filaments.

7. The method of claim 6, wherein the etching agent is selected from the group consisting of sodium hypochlorite, hydrogen peroxide, sodium borohydride and ammonium hydroxide.

8. The method of claim 7, wherein the second film is a polymer selected from the group consisting of PVC, PVdC-PAA copolymer, PVdC, polyester and polyolefin polymers.

9. A method of making a fabric having patterned conductivity, comprising the steps of:

depositing a conductive polypyrrole film on the fabric to provide a resistivity of 500 Ω/square or less;

coating selected areas of the fabric with a non-conductive protective film, whereby the protective film is resistant to a chemical etching agent for the polypyrrole film and an oxygen barrier, to retain areas of high conductivity;

applying the chemical etching agent to the fabric and degrading the polypyrrole film on areas of the fabric which have not been coated with the protective film to create areas of low conductivity; and rinsing the fabric to remove residual etching agent.

10. The method of claim 9 wherein the etching agent is an aqueous sodium hypochlorite solution and the protective film is selected from the group consisting of PVC, PVdC-PAA copolymer, PVdC, polyester and polyolefin polymers and the thickness of said protective film is between 0.01 and 0.2 mm.

* * * * *